US007275672B2

(12) United States Patent
Haen et al.

(10) Patent No.: US 7,275,672 B2
(45) Date of Patent: Oct. 2, 2007

(54) CENTER PULL DISPENSER WITH SELF-ADJUSTING DISPENSER MECHANISM

(75) Inventors: William G. Haen, DePere, WI (US); Daniel C. Kananen, New Franken, WI (US); Alan P. Paal, New Franken, WI (US); Alan J. Pierquet, Green Bay, WI (US)

(73) Assignee: Alwin Manufacturing Company, Inc., Green Bay, WI (US)

( * ) Notice: Subject to any disclaimer, the term of this patent is extended or adjusted under 35 U.S.C. 154(b) by 0 days.

(21) Appl. No.: 09/951,601

(22) Filed: Sep. 11, 2001

(65) Prior Publication Data

US 2003/0071102 A1 Apr. 17, 2003

(51) Int. Cl.
*B65H 35/10* (2006.01)

(52) U.S. Cl. ..... 225/106; 225/52; 225/96.5; 221/33; 221/220

(58) Field of Classification Search ..... 221/34, 221/26, 53, 58, 59, 220, 310, 32; 225/44, 225/106, 51, 52, 84–86, 96, 96.5, 90, 100, 225/101; 242/328, 160.3, 781.1, 390.2, 381.4
See application file for complete search history.

(56) References Cited

U.S. PATENT DOCUMENTS

| | | | |
|---|---|---|---|
| 1,563,867 | A | 12/1925 | Krueger |
| 1,605,496 | A | 11/1926 | Barbieri |
| 1,649,273 | A | 11/1927 | Wilson |
| 2,358,709 | A | 9/1944 | Hayn |
| 2,426,787 | A | 9/1947 | O'Neil |
| 2,923,435 | A | 2/1960 | Chaplin |
| 3,843,017 | A | 10/1974 | Harrison |
| 3,973,695 | A | 8/1976 | Ames |
| 3,982,659 | A | 9/1976 | Ross |
| 4,171,047 | A | 10/1979 | Doyle et al. |
| 4,180,160 | A | 12/1979 | Ogawa et al. |
| 4,314,679 | A | 2/1982 | Paul et al. |
| 4,586,631 | A | 5/1986 | Loder |

(Continued)

FOREIGN PATENT DOCUMENTS

| | | |
|---|---|---|
| CA | 2101295 | 2/1996 |

(Continued)

*Primary Examiner*—Boyer D. Ashley
*Assistant Examiner*—Phong Nguyen
(74) *Attorney, Agent, or Firm*—Jansson Shupe & Munger Ltd.

(57) ABSTRACT

A dispenser for dispensing flexible web material from a center pull roll capable of accommodating different types of web material in the form of sheets separated by lines of perforation. The dispenser includes dispenser apparatus permitting the device to self-adjust to the different thicknesses, sizes and physical characteristics of different types of web material. In certain preferred embodiments, the dispenser comprises a housing, a web support within the housing and structure permitting the dispenser to self-adjust to the effective cross-sectional area of the web. The preferred dispenser structure includes elements positioned to receive the web between them. At least one of the elements is movable and is biased for displacement toward the other. Frictional force applied against the web by the elements resists pull force applied to the web by a user so that a single web sheet separates from the web along the perforation between the elements and the lead end when a user pulls on the web outside the housing.

12 Claims, 9 Drawing Sheets

U.S. PATENT DOCUMENTS

| | | | | |
|---|---|---|---|---|
| 4,811,878 | A | | 3/1989 | Horinchi |
| 4,846,415 | A | | 7/1989 | Jernberg et al. |
| 4,905,868 | A | | 3/1990 | Beane et al. |
| 5,137,173 | A | | 8/1992 | Hughes et al. |
| 5,141,171 | A | | 8/1992 | Yang |
| 5,158,180 | A | | 10/1992 | Zucker |
| 5,205,455 | A | | 4/1993 | Moody |
| 5,211,308 | A | | 5/1993 | Decker et al. |
| 5,215,211 | A | | 6/1993 | Eberle |
| 5,219,126 | A | | 6/1993 | Schutz |
| 5,246,137 | A | | 9/1993 | Schutz et al. |
| 5,263,607 | A | | 11/1993 | Temesvary et al. |
| 5,285,927 | A | | 2/1994 | Pruitt |
| 5,316,177 | A | | 5/1994 | Boldt |
| 5,346,064 | A | | 9/1994 | Rizzuto |
| 5,358,140 | A | | 10/1994 | Pellegrino |
| 5,370,338 | A | | 12/1994 | Lewis |
| 5,458,259 | A | | 10/1995 | Falk |
| 5,462,197 | A | | 10/1995 | Pound |
| 5,467,893 | A | | 11/1995 | Landis, II et al. |
| 5,542,567 | A | | 8/1996 | Julius |
| 5,542,568 | A | | 8/1996 | Julius |
| 5,560,514 | A | | 10/1996 | Frazier |
| 5,577,634 | A | | 11/1996 | Morand |
| 5,582,362 | A | | 12/1996 | Johnson |
| 5,715,971 | A | | 2/1998 | Morand |
| 5,718,353 | A | | 2/1998 | Kanfer et al. |
| 5,749,492 | A | | 5/1998 | Petterson |
| 5,762,286 | A | | 6/1998 | Schutz |
| 5,762,287 | A | | 6/1998 | Schutz |
| 5,765,718 | A | | 6/1998 | Grasso et al. |
| 5,769,354 | A | | 6/1998 | Lindh et al. |
| 5,785,274 | A | | 7/1998 | Johnson |
| 5,829,322 | A | * | 11/1998 | Chen ..... 81/9.44 |
| 5,857,642 | A | | 1/1999 | Zinnbauer |
| 5,868,346 | A | | 2/1999 | Cobos |
| 5,890,633 | A | | 4/1999 | Skillin et al. |
| 6,003,723 | A | | 12/1999 | Morand |
| 6,082,663 | A | | 7/2000 | Tramontina et al. |
| 6,089,499 | A | | 7/2000 | Robinson |
| 6,109,473 | A | | 8/2000 | Neveu et al. |
| 6,129,239 | A | | 10/2000 | Fukazawa |
| 6,145,782 | A | | 11/2000 | King et al. |
| 6,158,614 | A | | 12/2000 | Haines et al. |
| 2002/0056718 | A1 | | 5/2002 | Paukov et al. |
| 2002/0139828 | A1 | | 10/2002 | Paukov |

FOREIGN PATENT DOCUMENTS

| | | |
|---|---|---|
| CA | 2170447 | 3/1999 |
| EP | 0836825 | 10/1997 |
| WO | WO/02/38019 | 5/2002 |

* cited by examiner

CENTER PULL DISPENSER WITH SELF-ADJUSTING DISPENSER MECHANISM

FIELD OF THE INVENTION

This invention is related generally to dispenser apparatus and, more particularly, to dispenser apparatus capable of accommodating more than one type of flexible sheet material.

BACKGROUND OF THE INVENTION

"Center pull" dispensers for dispensing flexible sheet material, such as paper towels and the like, are well known in the art. Center pull dispensers derive their name from the type of sheet material which they dispense. The sheet material is typically provided in the form of a center pull "web." The material comprising the web is divided into discrete sheets by spaced-apart, transverse lines of perforations in the web. The web is typically rolled onto itself and then wound into a roll in which the lead end extends from the center of the roll. The web is unwound from the center of the roll by pulling on the lead end.

Center pull dispensers used to dispense this type of web material typically consist of a dispenser housing and a base within the housing for supporting a roll of the web material. A "nozzle" having a wall defining a generally conical inner passageway depends from the base or housing. The web is passed through the nozzle as it is pulled out of the dispenser by the user. The nozzle is sized such that the cross-sectional area of the narrowest portion of the passageway is slightly less than the effective cross-sectional area of the web material. The nozzle provides frictional resistance to movement of the web as it is pulled away from the dispenser by the user.

Web material is dispensed when the user grasps the leading end of the web outside the dispenser and pulls the leading end away from the dispenser. The pull force applied by the user causes the web to unwind from the center of the roll. If the dispenser operates as intended, resistance to the pull force applied by nozzle will cause a single sheet of the web material to tear along the perforation line outside of the dispenser between the nozzle and the leading edge of the web. Examples of center pull dispensers include U.S. Pat. No. 5,868,346 (Cobos), U.S. Pat. No. 5,765,718 (Grasso et al.), U.S. Pat. No. 5,762,287 (Schutz) and U.S. Pat. No. 5,205,455 (Moody).

Center pull dispensers of the prior art are subject to a number of important disadvantages. One disadvantage is that the fixed size of the nozzle passageway imposes certain limitations on the ability of the dispenser to accommodate the broad range of different grades and types of web material provided by different manufacturers. Commercially-available web material can vary greatly with respect to its thickness, size and physical characteristics all of which influence the effective cross-sectional area of the web.

For instance, if the nozzle is sized to accommodate thick, heavy weight paper having a relatively large effective cross-sectional area then the nozzle will not impart sufficient frictional force to light weight paper having a smaller effective cross-sectional area. Such improper sizing of the dispenser to the web material results in a condition known as "roping" in which plural sheets are dispensed from the dispenser on a single pull. Disadvantageously, roping results in waste of the web material and causes the web to be prematurely depleted increasing the cost to operate the dispenser.

Conversely, a nozzle sized to accommodate light weight paper would cause thicker, heavy weight paper to "bunch up" in the nozzle so that the paper is unable to flow smoothly through the nozzle. This form of improper sizing of the dispenser to the web material results in conditions known as "tabbing" or "short pulling." Tabbing refers to a condition in which a small portion of the web sheet tears off in the user's hand and the user does not receive a sheet while short pulling involves a tearing of the web before the perforation thereby providing the user with more material than a tabbed sheet but less material than a full sheet. The tabbing and short pull conditions may make further removal of web from the dispenser difficult or impossible because the leading end of the web may be torn or too short to be grasped by a subsequent user.

A further disadvantage of the prior art dispensers is that movement of the web through the nozzle can cause excessive wear on the nozzle, particularly if the nozzle has an area sized too small for the effective cross-sectional area of the web. Excessive wear of the nozzle can reduce the nozzle's frictional resistance to the pull of the web resulting in the undesirable roping condition described above.

Efforts have been made to provide a dispenser capable of dispensing more than one type of sheet material each having different thicknesses, sizes and physical characteristics. However, these dispensers are not completely satisfactory for a number of important reasons. One disadvantage inherent in these types of dispensers is that the dispensers cannot be sized to the full range of commercially-available web material while another disadvantage involves the fact that these dispensers require undue manual adjustment. For example, the dispensers of U.S. Pat. No. 5,370,338 (Lewis) and U.S. Pat. No. 5,211,308 (Decker et al.) are provided with a limited number of differently-sized apertures which can be moved into registry with the nozzle thereby permitting limited adjustment of the nozzle area to the type of web material to be dispensed.

The dispenser of U.S. Pat. No. 5,749,492 (Petterson) is provided with manually-adjusted sizing rods or wall structure permitting the attendant to manually adjust the size of the aperture through which the web material is withdrawn from the dispenser. Further manual adjustment is required to re-set the rods or wall structure before a different type of web material can be dispensed.

The dispensers of U.S. Pat. No. 5,715,971 (Morand) and U.S. Pat. No. 5,246,137 (Schutz et al.) include a manually-positionable nozzle insert ring provided to permit the attendant to size the nozzle to the effective cross-sectional area of the paper. Disadvantageously, manual sizing of the rings is required. Moreover, the dispenser may become useless if the rings are lost or are inadvertently discarded.

Any requirement that the dispenser be manually adjusted to the effective cross-sectional area of the web material creates the likelihood that the dispenser nozzle or dispensing aperture will be set to a size unsuitable for the particular web material to be dispensed. This may result in roping or tabbing of the web material or in excessive wear to the dispenser. Further, any apparatus limiting the sizes of the aperture to one of several predetermined sizes restricts the range of web material potentially dispensable from the dispenser.

It would be a significant improvement in the art to provide a center pull dispenser apparatus with an improved dispenser mechanism that would reliably dispense different types of flexible sheet material thereby accommodating a range of different web material thicknesses, sizes and physical characteristics, which would self-adjust to the type of web material being dispensed and which would automatically compensate for wear thereby extending the operational life of the dispenser all resulting in improved dispenser performance and reduced costs to the operator.

OBJECTS OF THE INVENTION

It is an object of this invention to provide an improved dispenser apparatus overcoming some of the problems and shortcomings of the prior art.

Another object of this invention is to provide an improved dispenser apparatus which dispenses different types of flexible sheet material.

It is also an object of this invention to provide an improved dispenser apparatus which self-adjusts to the type of web material being dispensed.

Yet another object of this invention is to provide an improved dispenser apparatus which permits the operator to reduce costs of operation by permitting the operator to use web material from the most competitively-priced source.

A further object of this invention is to provide an improved dispenser apparatus which permits the operator to better tailor the properties of the web material to the needs of the user.

One object of this invention is to provide an improved dispenser apparatus which automatically compensates for wear thereby ensuring reliable dispensing of web material over time.

An additional object of this invention is to provide an improved dispenser apparatus which avoids excessive dispensing of the web material.

A further object of this invention is to provide an improved dispenser apparatus which avoids improper tearing of the web material Still another object of this invention is to provide an improved dispenser apparatus which has an improved design versus that of prior art dispensers.

An additional object of the invention is to provide an improved dispenser apparatus which has a rugged design yet is economical to manufacture and assemble.

A further object of this invention is to provide an improved dispenser apparatus which has an improved operational life.

These and other objects of the invention will be apparent from the following descriptions and from the drawings.

SUMMARY OF THE INVENTION

The invention relates in general to an improved dispenser apparatus capable of dispensing different types and grades of flexible web material. The inventive dispenser includes dispenser mechanism structure which self-adjusts to the different thicknesses, sizes and physical characteristics of different types and grades of web material. Advantageously, the inventive dispenser permits the operator to dispense a broad range of commercially-available web materials from a single dispenser.

Preferably, the web material to be discharged from the dispenser is provided in the form of a center pull roll. The web comprising the roll includes a lead end, an effective cross-sectional area and spaced apart perforations dividing the web into separate sheets. A single sheet is dispensed as the user pulls on the lead end of the web resulting in separation of the lead sheet along the perforation line between the dispenser and lead end.

In general, the preferred dispenser comprises a housing having walls defining a housing interior and a web support structure for supporting the web within the housing interior. The preferred dispenser mechanism comprises plural opposable elements mounted with respect to the housing such that at least one of the elements is movable. The elements act as "restriction" elements because they are designed to receive the web between them and to apply a frictional force against the web thereby limiting web movement in a predetermined manner. Biasing apparatus is provided to close the elements around the web positioned therebetween. The frictional force imparted to the web material by the restriction elements is sufficient to resist the pull force applied to the web by a user so that a single web sheet separates from the web along the perforation between the restriction elements and the lead end when a user pulls on the web outside the housing.

Preferably, the web support member comprises a shelf having upper and lower surfaces. The center pull web roll is supported on the top surface of the shelf within the dispenser. The shelf defines an orifice through which the web is passed through the shelf and to the restriction elements. It is also preferred that the housing walls further define a lower chamber disposed below the shelf. In such embodiment, the elements are mounted in the lower chamber and are positioned to receive the web from the orifice. Positioning of the elements within the lower housing chamber prevents unauthorized operation of the elements. In this form of the invention, a bottom wall below the elements defines a second orifice through which the web exits the housing after passing between the elements.

It is highly preferred that the dispenser further include a dispenser element depending from the shelf. It is most preferred that the dispenser element is integral with the shelf. The dispenser element has a first open end in registry with the orifice and a second open end spaced apart from the first end. The dispenser element is provided with at least one wall between the ends defining a downwardly converging passageway through which the web is directed toward the restriction elements. The dispenser element serves as a guide directing the web material to the restriction elements and is sized such that it does not impart frictional resistance to movement of the web therethrough thereby avoiding wear caused by movement of the web through the element.

It is most highly preferred that the restriction elements comprise first and second restriction elements each having a web-contact portion. The elements are mounted with respect to the housing such that each web-contact portion is positioned to face the other forming a passageway therebetween for receiving the web. At least one, and preferably each, of said elements are mounted for movement such that the web-contact portion of said element or elements is displaceable toward and away from the web in the passageway responsive to the effective cross-sectional area of the web. Biasing apparatus acts against one or more of the restriction elements to urge the web-contact portions of said elements toward the web causing the elements to exert the frictional force against the web.

It is most highly preferred that the restriction elements are mounted for movement in a scissors-like manner. Suitable mounting structure for the highly preferred form of the restriction elements may comprise a boss projecting downwardly from the shelf bottom surface in combination with a suitable fastener for securing the restriction elements to the boss along a common axis with one restriction element mounted above the other. In this embodiment, the biasing apparatus comprises a spring having one spring arm acting against one restriction element and the other spring arm acting against the second restriction element. The spring urges the web-contact portions toward each other.

The inwardly facing web-contact portions of the preferred restriction elements may have various profiles provided to facilitate movement of the web between the elements yet at the same time provide sufficient frictional force against the moving web so as to facilitate separation of the lead sheet at the perforation line between the lead end and restriction elements. It is most highly preferred that such restriction element profile comprises an arcuately-shaped surface profile.

Each restriction element web-contact portion may be further designed to include edge relief along the upper and lower edge surfaces of the upper restriction element and the upper edge surface of the lower restriction element. It is most highly preferred that these edge surfaces include a radius. As with the web-contact profile, such relief facilitates movement of the web along the elements without breakage. Such relief structure is particularly useful for those light weight webs which are easily compressed by the restriction elements and which follow an "s-shaped" or highly circuitous path between the overlapping restriction elements.

The invention further represents a significant advance over prior art products because of its elegant design. The invention requires only twelve parts. The few parts that are required are simple, require fewer moving parts and are easy to manufacture and assemble. All of these design advances contribute to a less expensive, more reliable dispenser apparatus.

BRIEF DESCRIPTION OF THE DRAWINGS

The drawings illustrate preferred embodiments which include the above-noted characteristics and features of the invention. The invention will be readily understood from the descriptions and drawings. In the drawings.

DETAILED DESCRIPTION OF PREFERRED EMBODIMENTS

FIGS. 1-7 illustrate embodiments of the inventive dispenser 10. The dispenser 10 is provided with a dispensing mechanism which self-adjusts to accommodate the different thicknesses, sizes and physical characteristics of differing types of web material 11, 11*a* thereby permitting the dispenser 10 to accommodate web material 11 from more than one commercial source.

Figure 1:
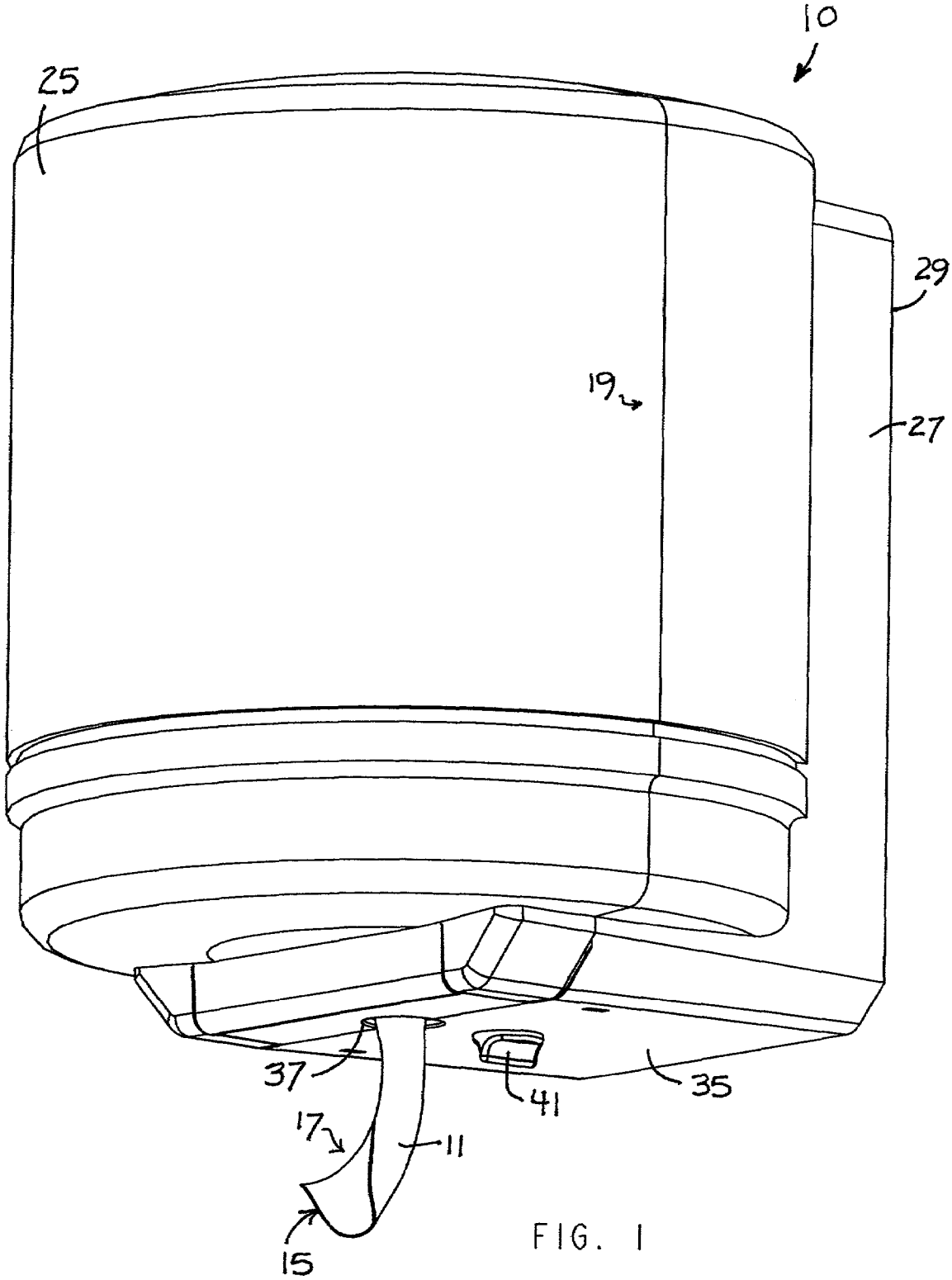
FIG. 1 is a perspective view of a preferred dispenser in accordance with the invention.
Figure 2:
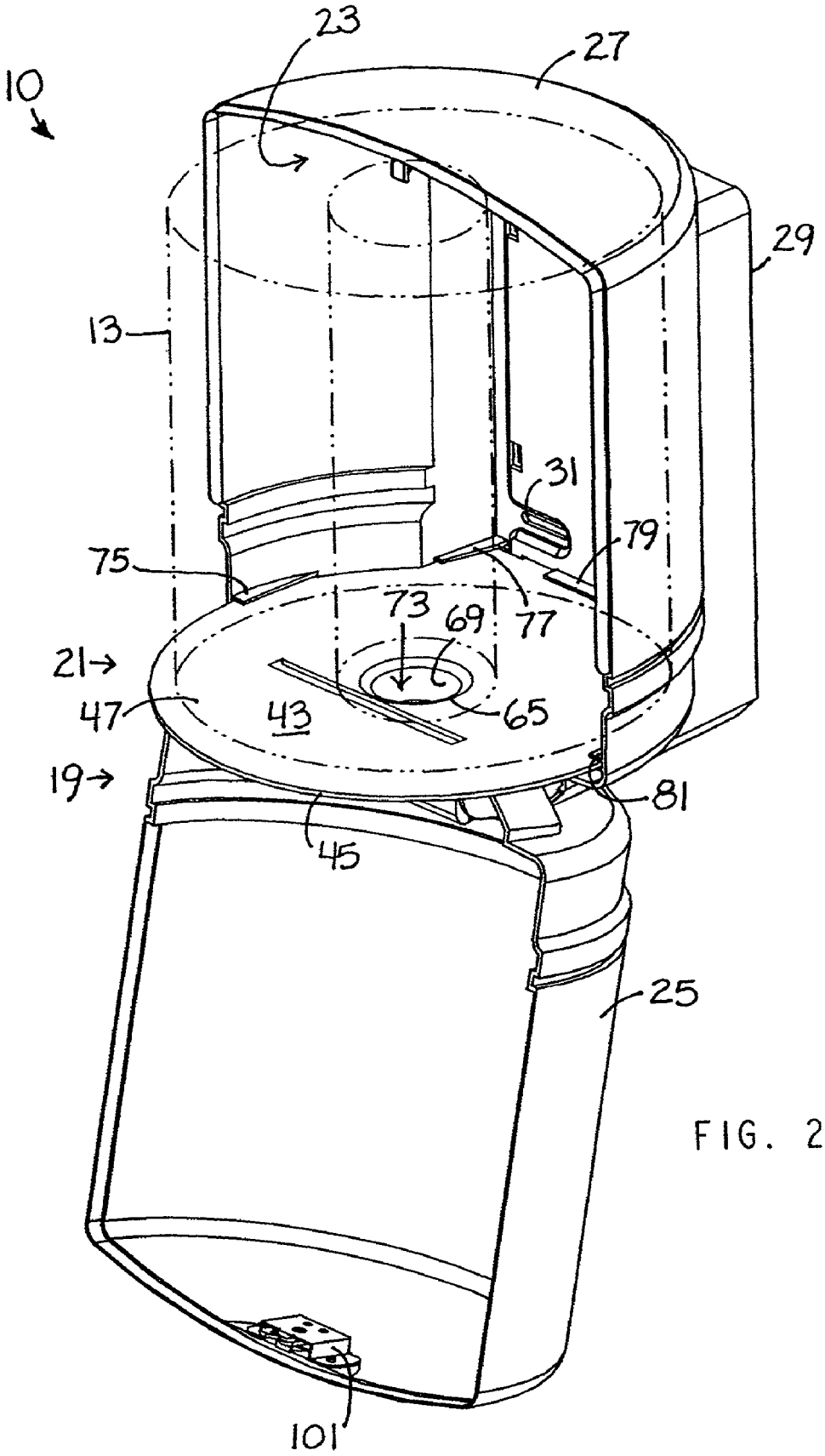
FIG. 2 is a perspective view of the dispenser of FIG. 1 with the housing cover removed and a web roll shown in phantom lines.

The web material 11 dispensed from dispenser 10 is preferably in the form of a center pull "web" roll 13 shown in phantom lines in FIG. 2. The web material 11 comprising the web roll 13 is divided into discrete sheets by spaced-apart, transverse lines of perforations along the edges (such as edge 15) of each sheet comprising the web material 11. The web material 11 is typically rolled onto itself and then wound into a roll 13 in which the leading end 17 extends from the center of the roll 13. The web is unwound from the center of the roll by pulling on the leading end 17.

The web material 11 has an effective cross-sectional area which is manifested by the thickness, size and physical characteristics of the web material 11. The effective cross-sectional area of the web material 11 refers to the two-dimensional space (i.e., length and width dimensions) occupied by the web material 11 taken along a section transverse to the web. Such a section is illustrated in FIG. 6C which is representative of a web 11 fashioned of a light-weight single-ply material and by FIG. 6F which is representative of a web 11*a* made of a heavier-weight two-ply material. As is well-shown in FIGS. 6C and 6F, the effective cross-sectional area of the single-ply web 11 is less than that of the heavier two-ply web 11*a*. The effective cross-sectional area of the web 11, 11*a* may also vary along the length of the web 11, 11*a* depending on whether there are any irregularities in the wound web material. The structure of the dispenser 10 permits the dispenser 10 to automatically adjust to the different, and potentially changing, effective cross-sectional areas of the web thereby avoiding excessive roping, tabbing or short pulling.

Turning now to FIGS. 1-7, those figures illustrate exemplary embodiments of a dispenser 10 according to the invention. Dispenser 10 preferably includes housing means 19 and support means 21 mounted within an interior portion 23 of housing means 19. Housing means 19 preferably includes a front cover 25 and housing rear portion 27 which, in combination, define a generally cylindrically-shaped housing means 19 and cylindrically-shaped interior portion 23. Such housing geometry, while not required, is preferred because it efficiently accommodates the generally cylindrically-shaped roll 13 form in which most commercially-available center pull paper webs are provided.

Housing rear portion 27 is provided to support the dispenser 10 for use. Preferably, rear portion 27 is a unitary member made of a molded plastic, such as ABS plastic, although other suitable materials may be used. Housing rear portion 27 includes a generally flat rear wall 29 which is adapted to be mounted to a support surface (not shown), such as a wall surface in a washroom or a column adjacent an automobile filling station gasoline pump. As best shown in FIG. 2, openings, such as opening 31, are provided in rear wall 29 to receive fasteners (not shown), such as screws or the like, which may then be secured to the support surface to support dispenser 10. Preferably, three other openings, identical to opening 31, are disposed along rear wall 29 in a symmetrical manner. It will be readily appreciated that the dispenser 10 may be supported along a support surface by other types of mounting means known to those of skill in the art. For example, a mounting plate (not shown) secured to a wall, pole or other support surface and designed to mate with housing rear wall 29 may be utilized.

Housing rear portion 27 further includes bottom wall 35. Bottom wall 35 includes opening 37 through which web material 11 exits dispenser 10. Opening 39 is further provided in bottom wall 27 to receive optional rotatable knob 41. Knob 41 is provided to assist the attendant with loading of the web material 11 as described in detail below.

The preferred support means 21 comprises a shelf 43 which is provided to support web roll 13 for dispensing. Shelf 43 is preferably a unitary member made of ABS plastic or other suitable material. Shelf 43 is bounded by edge 45 and includes a top surface 47 on which the roll 13 rests and bottom surface 49. Sidewalls 51, 53 and front and rear walls 55, 57 depend from shelf bottom surface 49. Compartment 59 is bounded by walls 51-57 in combination with shelf bottom surface 49 and bottom wall 35 inner surface 61. The force-applying means 63 is located in compartment 59 as described in more detail below.

Shelf 43 further includes orifice 65 and dispenser element 67. Dispenser element 67 includes first end 69 which is in communication with orifice 65, spaced apart second end 71 and a wall 72 therebetween defining a first passageway 73 through which web material 11 is directed out of dispenser interior 23 and to the force-applying means 63. Dispenser element 67 is provided as a guide to direct web material from the web roll 13 to the force-applying means 63 and is preferably sized so that the web 11 moves easily through passageway 73 as the web is unwound from the center of roll 13 in a circular pattern with the movement of web 11 causing minimal or no wear along dispenser element 67.

Figure 5:
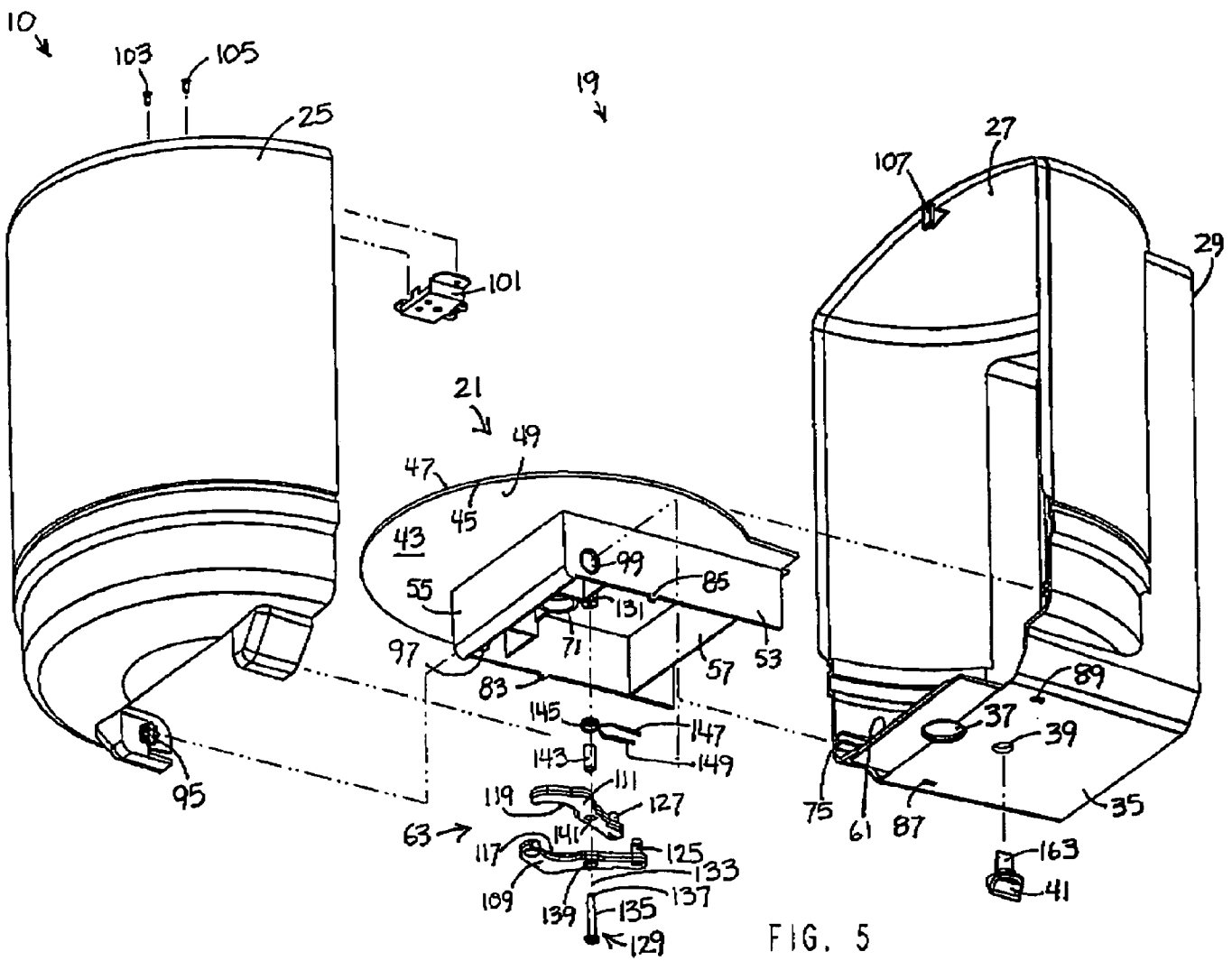
FIG. 5 is an exploded perspective view of the dispenser of FIGS. 1-4.

As best shown in FIGS. 2 and 5, shelf 43 is secured partially within housing rear portion 27 by engagement of edge 45 with slots 75-81 formed in rear portion 27. A further slot (not shown), which is a mirror image of slot 75, is further provided in rear portion 27 for engagement with edge 45. Shelf 43 is removably secured to housing rear portion 27 by catches 83, 85 which mate with respective openings 87, 89 in rear portion bottom wall 35 and barbs 91, 93 in shelf 43 which mate with corresponding openings (not shown) in rear wall 29. Dispenser element 67 is in registry with opening 37 when shelf 43 is secured with respect to rear portion 27.

Cover 25 is preferably a unitary member made of molded ABS plastic. Cover 25 may be made of other suitable materials and could be opaque or transparent/translucent thereby permitting roll 13 to be fully or partially observed through the cover 25. Cover 25 is removed, for example, to load a roll 13 into dispenser 10 or to service dispenser 10.

Figure 3:
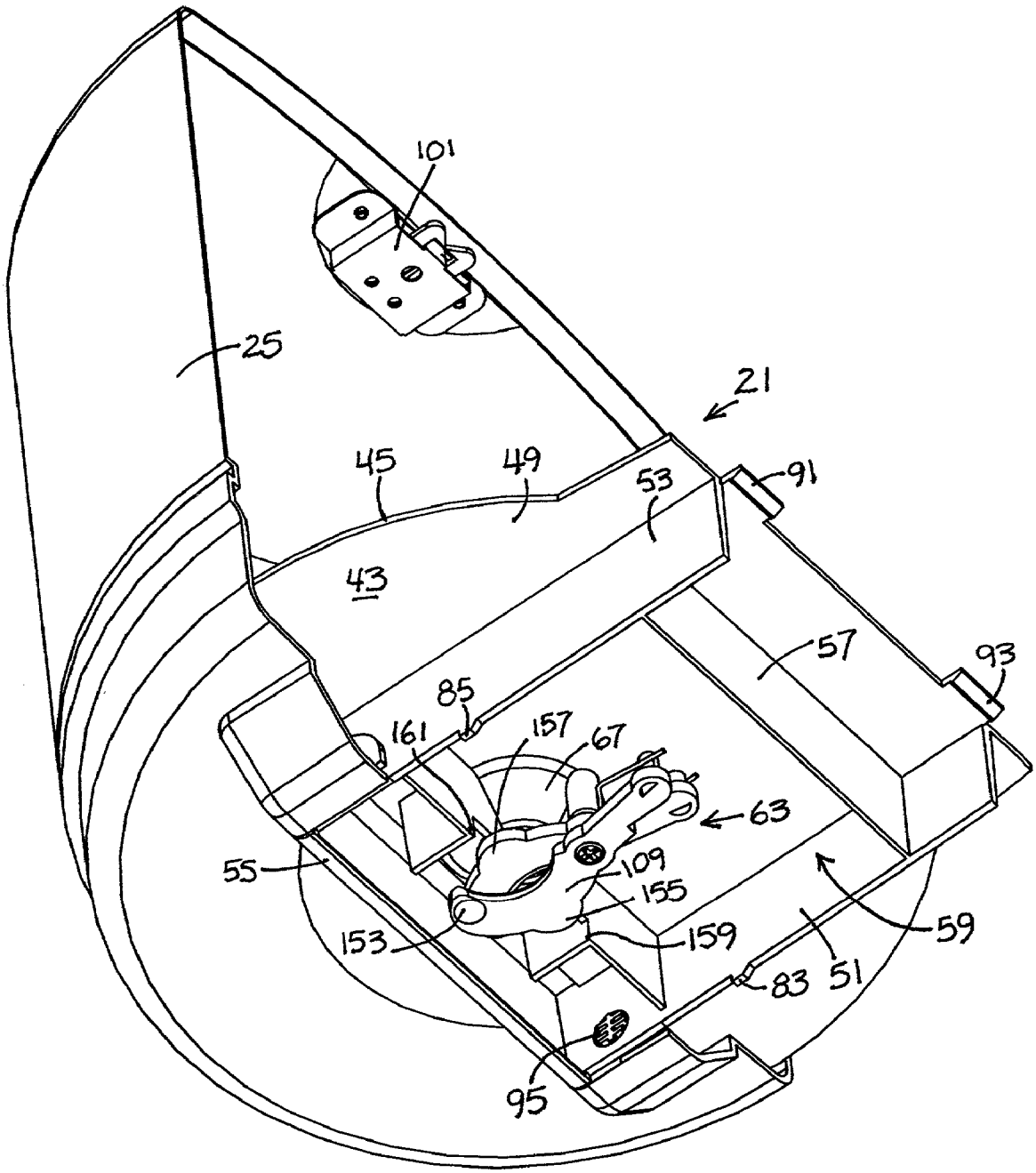
FIG. 3 is another perspective view of the dispenser of FIG. 1 with the web removed and the shelf and front housing cover removed from the housing rear portion.

As shown in FIGS. 2-3 and 5, cover 25 is preferably attached for pivotal movement to shelf sidewalls 51, 53 by means of engagement of opposed axially aligned posts (post 95 is shown; the other post is a mirror image of post 95) with openings 97, 99 in respective shelf side walls 51, 53. A lock mechanism 101 may be secured to cover 25 by rivets 103, 105 for mating with pin 107 on housing rear portion 27 to prevent unauthorized removal of cover 25.

Figure 4A:
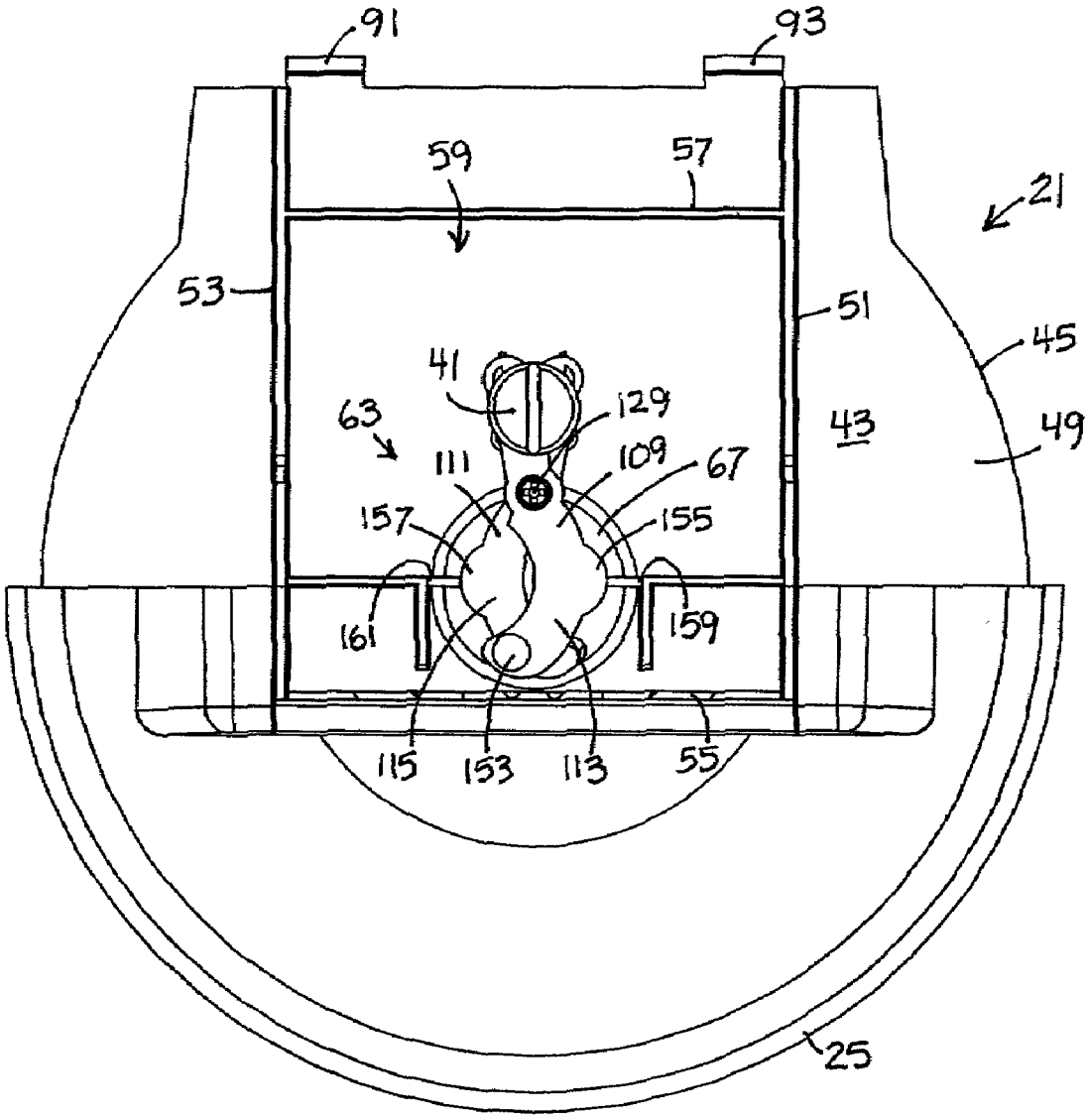
FIG. 4A is a perspective view of the underside of the shelf and front cover of FIG. 3 including an optional knob provided to assist in loading web material.
Figure 4B:
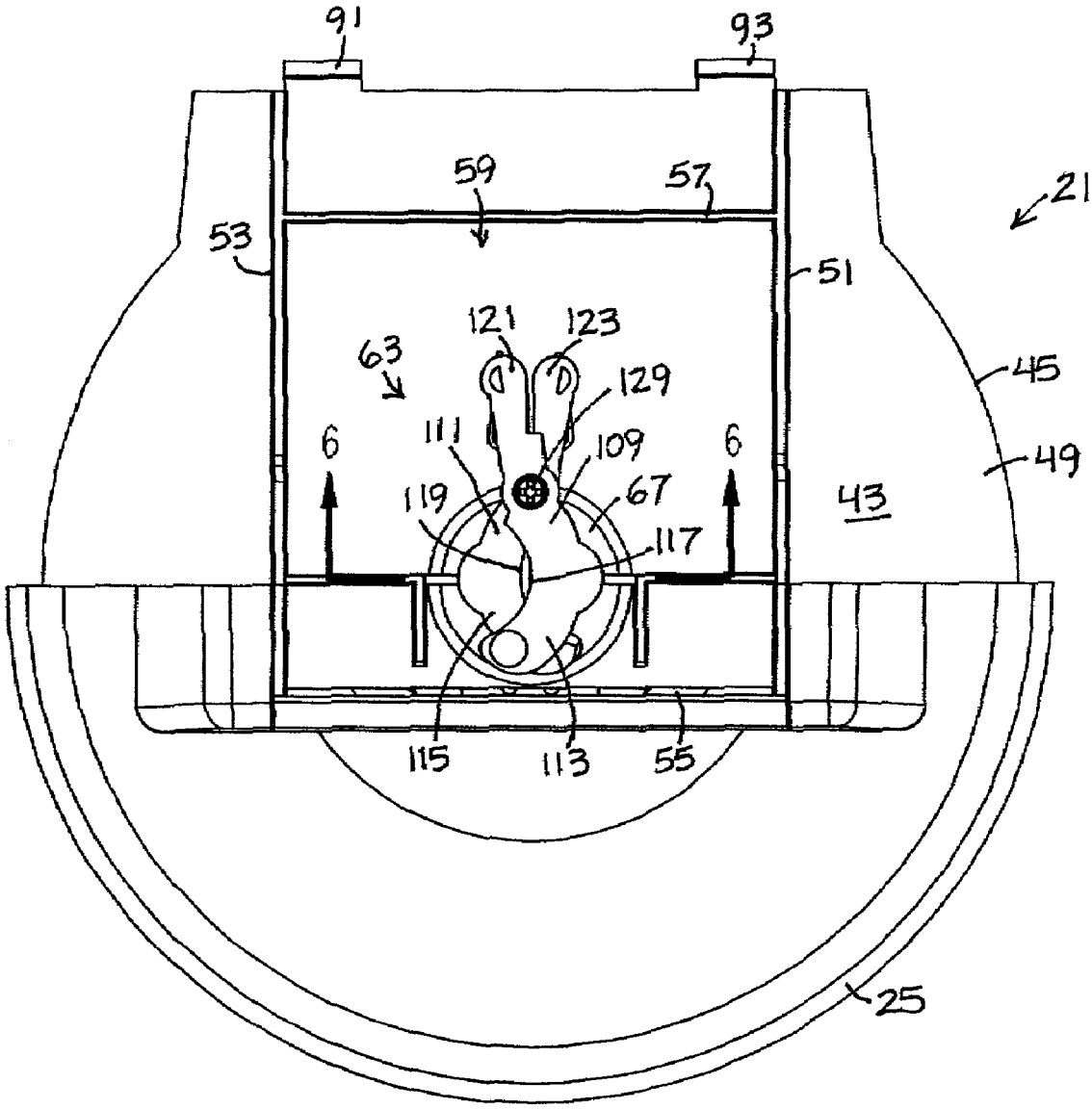
FIG. 4B is a perspective view of the embodiment of FIG. 3 with the optional knob removed.

A highly preferred form of the force-applying means 63 comprising the self-adjusting dispenser mechanism is illustrated in FIGS. 3-7. FIGS. 3-5 illustrate the preferred force-applying means 63 secured to the shelf 43 removed from rear portion 27 while FIGS. 6-7 provide sectional and plan views of components of preferred forms of the force-applying means 63.

The force-applying means 63 shown in these figures comprises first and second restriction elements 109, 111 mounted with respect to dispenser element 67 and dispenser element second end 71. Each restriction element 109, 111 comprises a "jaw" portion 113, 115 with an inwardly facing web-contact portion 117, 119. Each restriction element 109, 111 further includes an arm portion 121, 123 and a post 125, 127 for receiving a spring arm 147, 149. Restriction elements 109, 111 may be made of nylon or any suitable wear-resistant material.

Pin 129 coaxially secures restriction elements 109, 111 to boss 131 along pivot axis 133 with restriction element 109 positioned below restriction element 111. Pin 129 has a cylindrical body 135 and threads 137 which secure pin 129 to boss 131. Pin 129 is inserted through respective openings 139, 141 in each restriction element 109, 111 and bushing 143 is positioned over the pin body 135 and through openings 139, 141. Bushing 143 is sized with an inside diameter closely approximating the outside diameter of the pin body 135 and an outside diameter closely approximating the inside diameters of openings 139, 141 thereby permitting smooth pivoting displacement of restriction elements 109, 111 back and forth in an overlapping, scissors-like manner. Bushing 143 is preferably made of a wear-resistant material, such as Acetal.

Torsion spring 145 is positioned over bushing 143 with each spring arm 147, 149 positioned against a respective post 125, 127. Spring 145 biases arm portions 121, 123 one toward the other thereby causing jaw portions 113, 115 to be urged together to impart a frictional force on web material 11 in passageway 151 defined by jaw portions 113, 115. The passageway 151 is preferably elliptical in a bottom plan view as shown best in FIGS. 6B and 6E (and FIGS. 3-4). As described in the operation section below, spring 145 self-adjusts restriction elements 109, 111 by causing the jaw portions 113, 115 of said elements 109, 111 to be displaced toward the web 11 responsive to the unique effective cross-sectional area of the web 11 passing therethrough thereby imparting sufficient frictional force to permit separation of a sheet along a perforation line outside the dispenser 10. While a torsion spring 145 is shown, it should be understood that any suitable biasing means may be used with the invention.

The highly preferred restriction elements 109, 111 may include certain optional structure provided to facilitate trouble-free operation of dispenser 10. For example, lower restriction element 109 may include a boss 153 depending therefrom. Boss 153 is positioned for sliding engagement across bottom wall inner surface 61 thereby providing further support for restriction elements 109, 111.

Lobes 155, 157 may be provided in restriction elements 109, 111 for engagement, respectively, with ribs 159, 161 to facilitate threading of the web between jaw portions 113, 115, particularly in connection with dispenser embodiments which do not include optional knob 41. In such embodiments, engagement of lobes 155, 157 with respective ribs 159, 161 limits pivotal movement of restriction elements 109, 111 so that the web 11 can be more easily threaded between restriction element jaw portions 113, 115 during loading of a fresh roll of web material into the dispenser.

Knob 41, if provided, is inserted through housing bottom wall opening 39 and is rotatably mounted in the bottom wall 35 by a clip (not shown) secured along bottom wall inner surface 61. Knob 41 includes blade 163 inserted between restriction element arm portions 121, 123. Clockwise or counterclockwise rotation of knob 41 by about 90° causes blade 163 to urge arm portions 121, 123 apart thereby spreading jaw portions 113, 115 permitting the attendant to more easily thread web material 11 between jaw portions 113, 115 and through passageway 151 during loading of a new web roll into dispenser 10.

It is most highly preferred that each inwardly facing web-contact portion 117, 119 comprises an arcuately-shaped surface such as shown in FIGS. 4-6. However, and as shown in the bottom plan views of FIGS. 7A-7B, other restriction element configurations 109*a*, 111*a* and 109*b*, 111*b* are suitable for use with the inventive dispenser 10. For example, the jaw portions 113*a*, 115*a* and web-contact portions 117*a*, 119*a* of the elements of FIG. 7A are configured to form a passageway 151*a* in the shape of a parallelogram. As shown in FIG. 7B, the jaw portions 113*b*, 115*b* and web-contact portions 117*b*, 119*b* are configured to form a passageway 151*b* having a generally oval-shaped geometry.

Figure 6A:
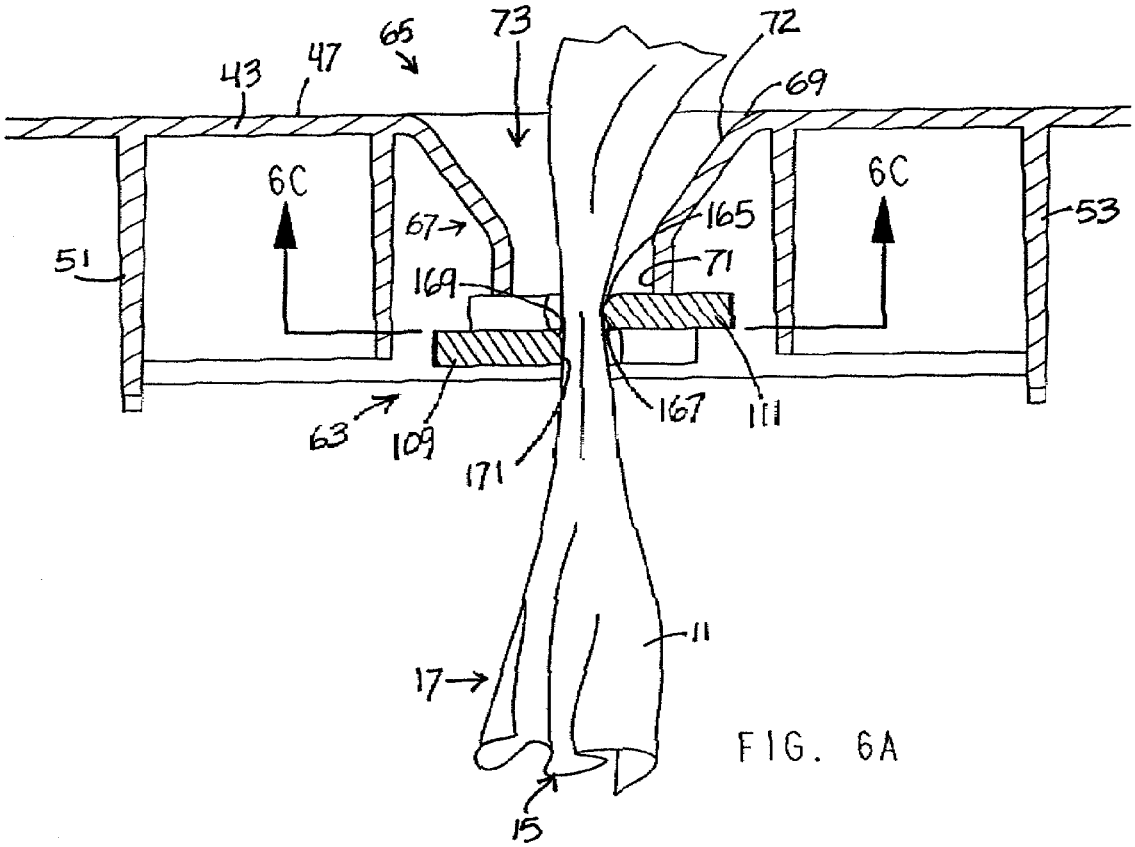
FIG. 6A is a partial sectional view taken along section line 6-6 of FIG. 4B showing the dispenser with a light weight single-ply web positioned between the restriction elements in position for dispensing.
Figure 6B:
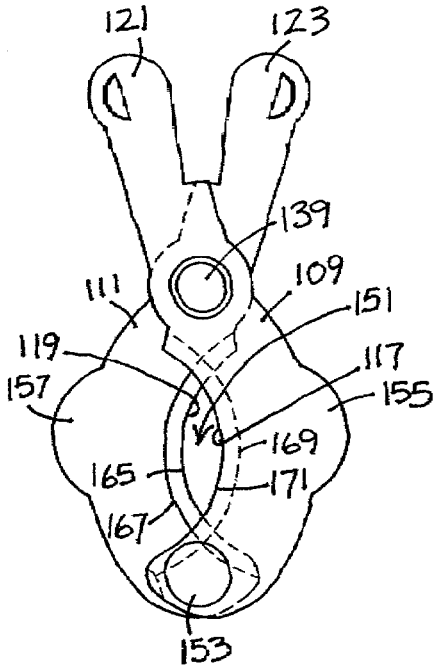
FIG. 6B is a bottom plan view of the restriction elements of FIG. 6A without other dispenser structure or the web material provided to show the relative position of the restriction elements.
Figure 6C:
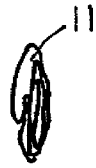
FIG. 6C is a partial sectional view taken along section line 6C-6C of FIG. 6A showing the effective cross-sectional area of the web of FIG. 6A.
Figure 6D:
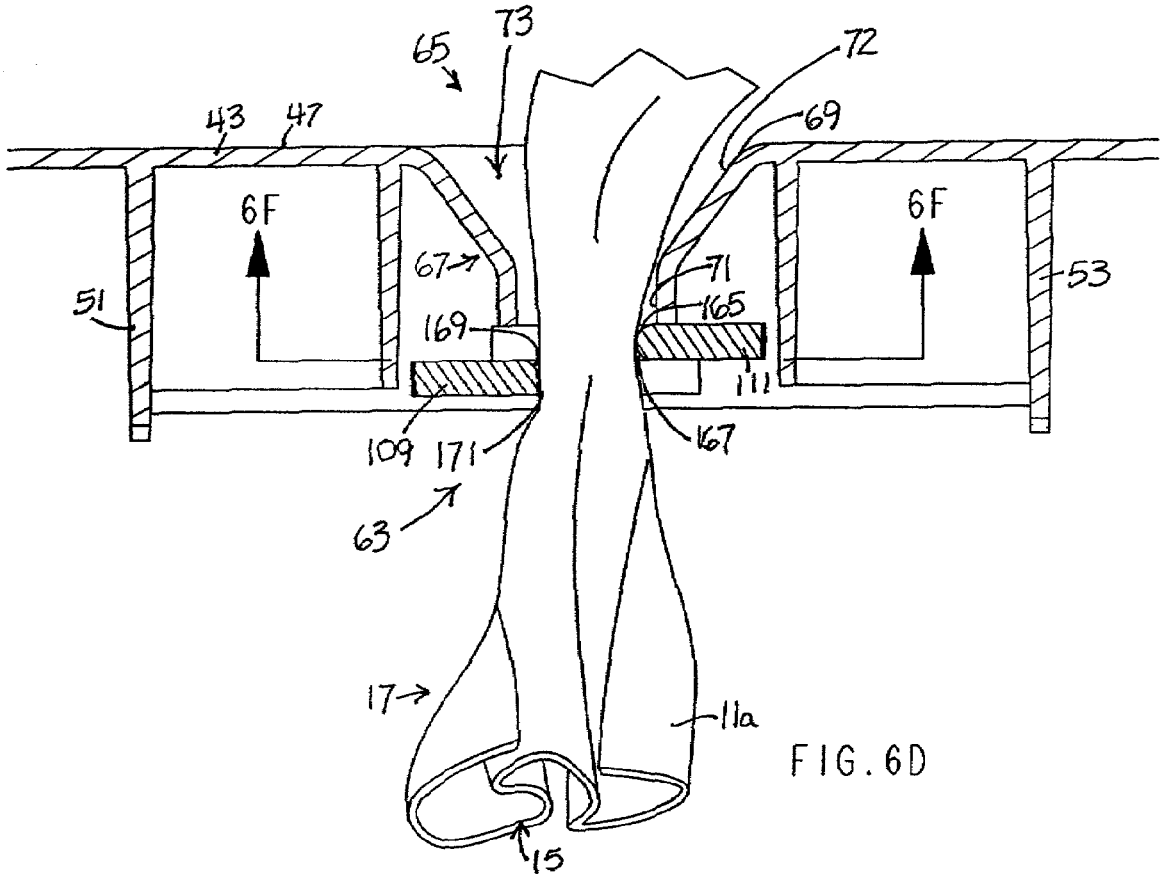
FIG. 6D is a partial sectional view taken along section line 6-6 of FIG. 4B showing the dispenser with a heavy weight two-ply web positioned between the restriction elements in position for dispensing.
Figure 7B:
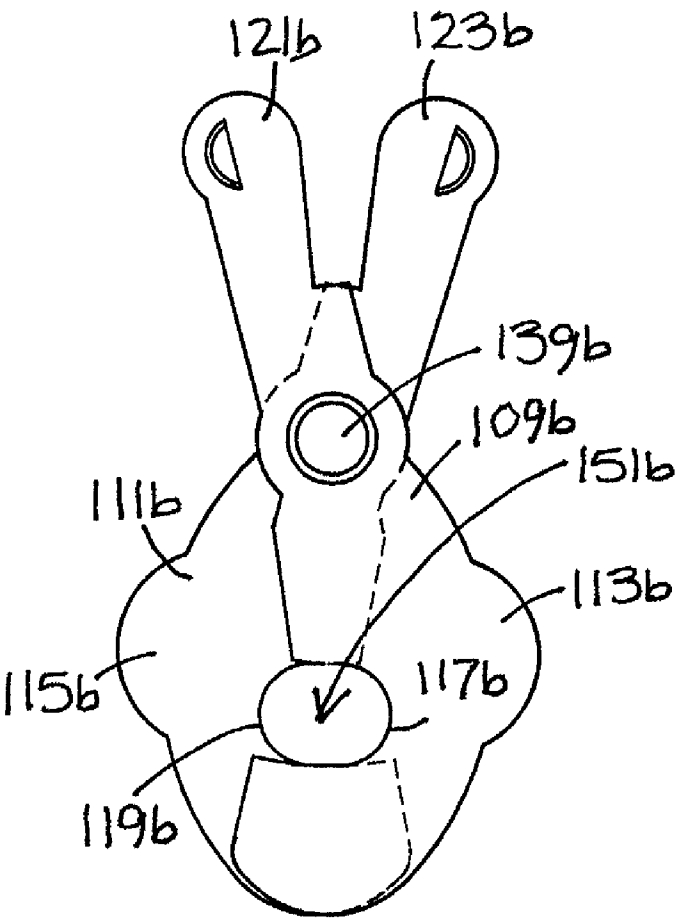
FIG. 7B is a bottom plan view of a further alternative restriction element embodiment.
Figure 7A:
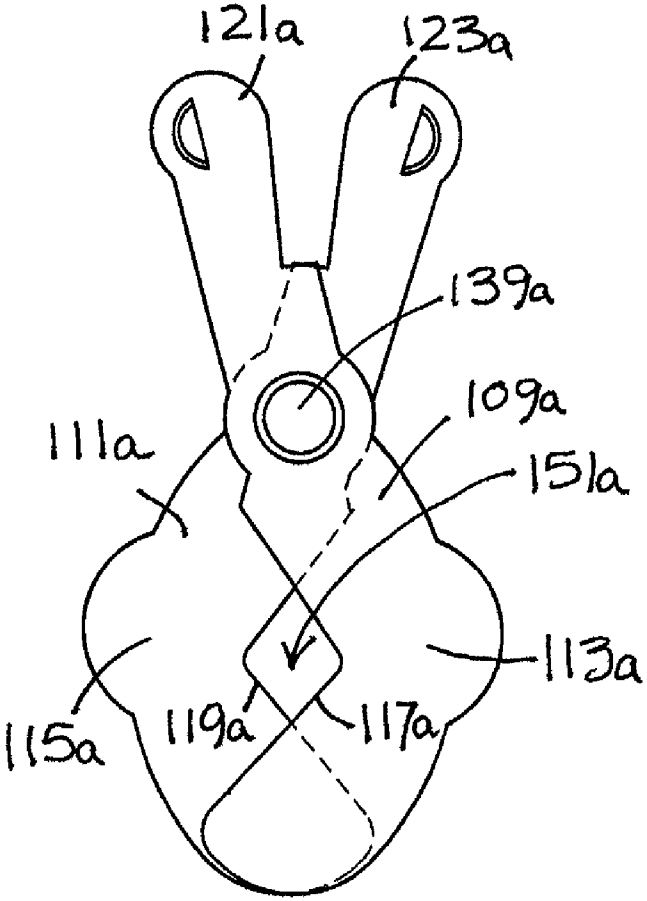
FIG. 7A is a bottom plan view of an alternative restriction element embodiment.

It is also preferred that the upper and lower edge surfaces 165, 167 of web-contact portion 117 and the upper edge surface 169 of web-contact portion 119 are relieved in order to facilitate movement of web 11 through the passageway 151 formed between the overlapping restriction elements 109, 111 as shown in FIGS. 6A and 6D. A preferred form of relief consists of a radius along the edge surfaces 165-169. The radii along edges 165-169 facilitate smooth movement of the web material 11 over restriction elements 109, 111 as the web 11 is unwound in a circular fashion from the center of the roll while the preferred squared edge surface 171 of web-contact portion 119 imparts a frictional force against web 11 facilitating separation of the web along the perforation line outside of the dispenser 10.

People of skill in the art will recognize that significant variation is possible with respect to the structure of the components comprising the force-applying means 63. For instance, the abovementioned components are not limited to the sizes or ranges set forth above and may be sized and configured as appropriate to meet the needs of the particular user. Alternative materials may be used in manufacture of the components. For example, restriction elements 109, 111 may be made of steel rather than nylon. The restriction elements 109, 111 may be sized and configured for web material other than paper webs, for example webs made of cloth fiber or webs made of blends of cloth and paper fiber.

By way of further example, a fixed restriction element (not shown) may be used in combination with a movably-mounted restriction element (not shown). In such an embodiment, the movably-mounted restriction element is biased such that its web-contact portion is urged toward the web-contact portion of the fixed restriction element with the web material passageway formed therebetween.

Operation of the exemplary dispenser 10 will now be described. Cover 25 is first opened to provide access to housing interior 23. A roll 13 of flexible web material is placed onto and is supported by shelf top surface 47. If provided, knob 41 is rotated about 90° to separate jaw portions 113, 115. The lead end 17 of web material 11 is led from the roll center through passageway 73 provided in dispenser element 67, through passageway 151 between jaw portions 113, 115 and out of the dispenser 10 through opening 37. Knob 41 is rotated a further 90° whereupon the jaw portions 113, 115 are urged together with web-contact portions 117, 119 in contact with web material 11.

Figure 6E:
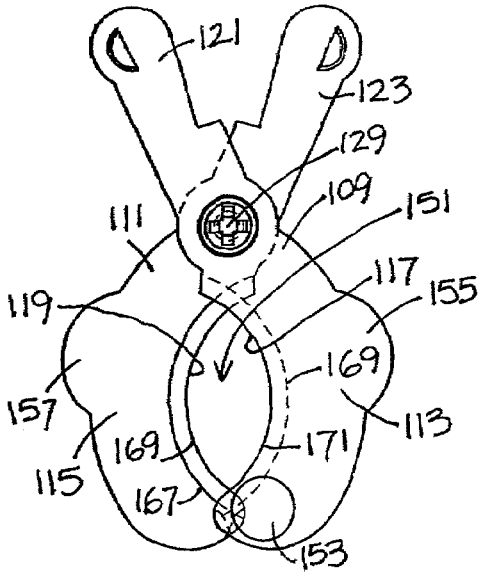
FIG. 6E is a bottom plan view of the restriction elements of FIG. 6D without other dispenser structure or the web material provided to show the relative position of the restriction elements.
Figure 6F:
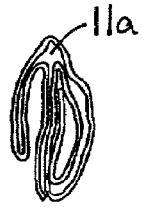
FIG. 6F is a partial sectional view taken along section line 6F-6F of FIG. 6D showing the relatively larger effective cross-sectional area of the two-ply web of FIG. 6D as compared to the effective cross-sectional area of the single-ply web of FIG. 6C.

By comparing FIGS. 6A-6C with FIGS. 6D-6F it will be readily apparent that jaw portions 113, 115 are self-adjusted to the effective cross-sectional area of the web material 11. The position of restriction elements 109, 111 when in contact with a light weight single-ply web 11 (FIG. 6C) is shown in FIGS. 6A-6B. FIG. 6B, which represents the position of restriction elements 109, 111 of FIG. 6A with the web material removed, shows the relatively narrow passageway 151 provided by jaw portions 113, 115. Conversely, FIGS. 6D-6E show the position of restriction elements 109, 111 when in contact with a heavy weight two-ply web 11*a* (FIG. 6F). FIG. 6E, which represents the restriction elements 109, 111 of FIG. 6D, shows that the jaw portions 113, 115 will self-adjust to provide a relatively wider passageway 151 to accommodate the greater cross-sectional area of the two-ply web 11*a*.

The user grasps the lead end 17 of the web material and pulls down. Frictional force provided by restriction elements 109, 111, as self-adjusted to the effective cross-sectional area of the web material 11, opposes the pull force provided by the user. Resistance to movement of the web material 11 causes the web material 11 to separate along the perforation line between the lead edge 17 and the opening 37. As a result, a single sheet of web material is provided to the user and the lead end of the next sheet is extended out of the dispenser 10 whereupon the lead end may be grasped by another user to initiate another dispensing cycle.

Important benefits flow from the capability of the dispenser 10 to self-adjust to the effective cross-sectional area web material. Most notably, the dispenser is capable of dispensing more than one type or grade of web material thereby permitting the operator to select web material for use with the dispenser which is most cost-effective and best suited to the needs of the end user. Self-adjustment of the dispensing mechanism avoids the need for an attendant to manually adjust the size of the dispenser orifice thereby avoiding unnecessary waste or loss of web material. Self-adjustment of the dispensing mechanism also minimizes wear on the dispenser caused by improper sizing of the dispenser to the web material to be dispensed. Moreover, self adjustment of the dispensing mechanism prolongs the operational life of the dispenser by automatically compensating for any wear on the dispensing mechanism which might occur. The design of the dispenser, and its requirement for a relatively small number of parts, permits the dispenser to be manufactured in a cost-effective manner.

EXAMPLES AND DATA

A dispenser embodiment in accordance with the invention was tested to evaluate operation of the dispenser with a broad range of commercially-available paper web products. The dispenser was configured as shown in FIGS. 1-6 including the dispenser housing 19, shelf 43, dispenser element 67 and force-applying means 63 as shown in these figures. The restriction element configuration was as shown in FIGS. 4-6 including first and second restriction elements 109, 111 each mounted for movement one above the other in an overlapping, scissors-like manner. Each jaw portion 113, 115 had a center radius of 0.625 inch. The upper and lower edges 165, 167 of upper web-contact portion 119 had a full 0.188 inch radius while the upper edge surface 169 along lower web contact portion 117 had a radius of 0.093 inch. The restriction elements 109, 111 were constructed of nylon having a thickness of 0.188 inch.

Torsion spring 145 was made of steel wire with a diameter of 0.047 inches. The maximum spring force at the maximum restriction element opening was 2.06 pounds/inch and the initial spring force at the minimum restriction element opening was 0.43 pounds/inch. The distance from the spring pivot axis 133 to the spring posts 125, 127 was 1.05 inch.

The evaluations were conducted with seventeen commercially-available paper web samples listed in Table 1 below. In each evaluation, the dispenser was loaded with the sample paper and tested for a total of 40 pull cycles. Each cycle consisted of gripping the lead edge of the web and pulling the web downwardly from the dispenser to simulate typical operating conditions.

Observations were recorded with respect to operation of the invention with each of the samples. Observations were made with respect to roping (i.e., more than one sheet of web material is dispensed without separation of the sheets at the perforation), tabbing (i.e., a small portion of the web sheet tears off in the user's hand so that the user does not receive a full sheet) and short pulling (i.e., tearing of the web before the perforation thereby providing the user with more material than a tabbed sheet but less material than a full sheet). An optimal result consists of a single sheet being dispensed with no roping, tabbing or short pulling. The data are as follows:

TABLE 1

| Sample No. | Number Sampled | Web Material Description | Test Results (after 40 pulls) |
|---|---|---|---|
| 1 | 1 | 1 Ply Soft Towel | 0 Tabs, 0 Ropes, 0 Short Pulls |
| 2 | 2 | 1 Ply Soft Towel | 0 Tabs, 9 Ropes, 0 Short Pulls |
| 3 | 3 | 1 Ply Soft Towel | 0 Tabs, 1 Rope, 0 Short Pulls |
| 4 | 4 | 1 Ply Soft Towel | 0 Tabs, 6 Ropes, 0 Short Pulls |
| 5 | 1 | 1 Ply Ultra Light Towel | 0 Tabs, 1 Rope, 0 Short Pulls |
| 6 | 2 | 1 Ply Ultra Light Towel | 0 Tabs, 0 Ropes, 0 Short Pulls |
| 7 | 1 | 2 Ply Soft Medium Weight Towel | 0 Tabs, 6 Ropes, 0 Short Pulls |
| 8 | 2 | 2 Ply Soft Medium Weight Towel | 0 Tabs, 0 Ropes, 0 Short Pulls |
| 9 | 3 | 2 Ply Soft Medium Weight Towel | 0 Tabs, 1 Rope, 0 Short Pulls |
| 10 | 4 | 2 Ply Soft Medium Weight Towel | 0 Tabs, 0 Ropes, 0 Short Pulls |
| 11 | 5 | 2 Ply Soft Medium weight Towel | 0 Tabs, 0 Ropes, 0 Short Pulls |
| 12 | 6 | 2 Ply Soft Medium Weight Towel | 0 Tabs, 40 Ropes, 0 Short Pulls (inadequately perforated) |
| 13 | 7 | 2 Ply Soft Medium Weight Towel | 0 Tabs, 9 Ropes, 0 Short Pulls |
| 14 | 1 | 1 Ply Light Kraft Towel | 0 Tabs, 9 Ropes, 0 Short Pulls |
| 15 | 1 | 2 Ply Light Towel | 0 Tabs, 0 Ropes, 0 Short Pulls |
| 16 | 1 | 1 Ply Soft Light Wiper | 0 Tabs, 0 Ropes, 0 Short Pulls |
| 17 | 2 | 1 Ply Soft Light Wiper | 0 Tabs, 40 Ropes, 0 Short Pulls (material stretches) |

As indicated, the exemplary dispenser worked well across the range of web materials noted. There was minimal paper breakage or excessive dispensing in the paper range from single-ply light wipers to two-ply medium tissue. This range of papers is suitable for use in a wide range of applications from institutional settings to public washrooms.

The results of sample numbers 12, 13 and 17 are due to anomalies or defects in the papers. The papers of sample numbers 12 and 13 were inadequately perforated and would be expected to show roping on all dispensers not sized precisely to such papers. The material of sample 17 exhibited excessive roping because the web material stretched and would not tear. Again, such paper would require a dispenser sized precisely to that paper.

The data demonstrate that the inventive dispenser may be used with web material from many different commercial sources thereby providing the operator with flexibility to better meet the needs of the user and obtain web material from the most competitive source.

While the principles of this invention have been described in connection with specific embodiments, it should be understood clearly that these descriptions are made only by way of example and are not intended to limit the scope of the invention.

We claim:

1. A center pull dispenser for dispensing a web from a center pull roll, the web having an effective cross-sectional area and perforated lines across the web at spaced apart intervals dividing the web into separate sheets, the dispenser comprising:

a housing structured to enclose the center pull roll;

upper and lower self-adjusting pivoting web-contact elements pivotably interconnected at midsections thereof, the web-contact elements being pivotably mounted with respect to the housing for movement toward and away from each other; and biasing apparatus secured with respect to the web-contact elements and biasing them toward each other and into continuous contact with the web even as the web effective cross-sectional area changes during user web pulling, to exert a force against the web such that a lead sheet separates from the web along a perforation line as the web is pulled by a user.

2. The dispenser of claim 1 wherein the biasing apparatus comprises a spring.

3. The dispenser of claim 2 wherein the spring is a torsion spring having one spring arm in contact with one web-contact element and an other spring arm in contact with the other web-contact element.

4. The dispenser of claim 2 wherein the web-contact elements are mounted on a common pivot axis.

5. The dispenser of claim 2 wherein each web-contact element comprises:

a jaw portion for continuously contacting the web; and an arm portion in contact with the biasing apparatus.

6. The dispenser of claim 5 wherein each jaw portion includes a web-contact portion and the web-contact portions face each other to define a passageway for the web therebetween.

7. The dispenser of claim 6 wherein the passageway has a cross-sectional shape selected from the group consisting of an ellipse, a parallelogram and an oval.

8. The dispenser of claim 6 wherein one web-contact element is an upper web-contact element, the other web contact-element is a lower web-contact element and the web-contact portion of the upper web-contact element has edge surfaces which are relieved and the web-contact portion of the lower web-contact element has edge surfaces, at least one of which is relieved.

9. The dispenser of claim 2 wherein the housing includes:

a shelf for supporting the center pull roll; and a shelf surface defining a shelf orifice through which the web is directed from the center pull roll toward the web-contact elements.

10. The dispenser of claim 9 wherein the housing further includes:

at least one wall defining an upper chamber for receiving the center pull roll and a lower chamber disposed below the shelf in which the web-contact elements are mounted; and a surface along the at least one wall defining a housing opening through which the web exits the housing after passing between the web-contact elements.

11. The dispenser of claim 10 further including a dispenser element depending from the shelf in communication with the shelf orifice and aligned with the housing opening, said dispenser element having at least one wall defining a downwardly converging passageway through which the web is directed toward the web-contact elements.

12. The dispenser of claim 10 further including:

a boss projecting downwardly from the shelf proximate the shelf orifice;

a fastener pivotably securing the web-contact elements to the boss in a position aligned with the shelf orifice; and the spring has one spring portion secured with respect to one web-contact element and an other spring portion secured with respect to the other web-contact element and the spring biases the web-contact elements to pivot about the fastener.

* * * * *